US006542568B1

(12) United States Patent
Howes, Jr. et al.

(10) Patent No.: US 6,542,568 B1
(45) Date of Patent: Apr. 1, 2003

(54) SOAP DISPENSER HAVING REWARD PROGRAM

(75) Inventors: Ronald Bruce Howes, Jr., Minneapolis, MN (US); James L. Copeland, Apple Valley, MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

(21) Appl. No.: 09/458,478

(22) Filed: Dec. 9, 1999

(51) Int. Cl.[7] ..... G07C 3/00
(52) U.S. Cl. ..... 377/16; 377/21; 377/26
(58) Field of Search ..... 377/16, 21, 26

(56) References Cited

U.S. PATENT DOCUMENTS

| | | | | |
|---|---|---|---|---|
| 4,194,242 A | | 3/1980 | Robbins | 364/200 |
| 4,334,270 A | | 6/1982 | Towers | 364/300 |
| 4,597,046 A | | 6/1986 | Musmanno et al. | 364/408 |
| 4,739,478 A | | 4/1988 | Roberts et al. | 364/408 |
| 4,896,144 A | | 1/1990 | Bogstad | 340/691 |
| 5,625,659 A | | 4/1997 | Sears | 377/21 |
| 5,945,910 A | | 8/1999 | Gorra | 340/573.1 |
| 6,065,639 A | * | 5/2000 | Maddox et al. | 222/36 |
| 6,206,238 B1 | * | 3/2001 | Ophardt | 222/1 |

FOREIGN PATENT DOCUMENTS

| | | |
|---|---|---|
| EP | 0 848 114 A3 | 6/1998 |
| EP | 0 963 728 A2 | 12/1999 |

OTHER PUBLICATIONS

Willis, D., editor, "Cleanliness No Longer Next to Impossible", PropertyAndCasualty.com, *Industry News*, 2 pgs. (May 5, 1998).

* cited by examiner

*Primary Examiner*—Margaret R. Wambach
(74) *Attorney, Agent, or Firm*—Merchant & Gould P.C.

(57) ABSTRACT

A system for rewarding and encouraging compliance with a predetermined personal hygiene standard in a hygiene compliance program. The system comprises a fluid dispenser. The fluid dispenser includes an actuator. A sensor is connected to the actuator. A processor in electrical communication with the sensor. The processor is configured to increment a count when the sensor is actuated, relate the count to the identification code, and compare the count to a predetermined number.

25 Claims, 8 Drawing Sheets

SOAP DISPENSER HAVING REWARD PROGRAM

TECHNICAL FIELD

The present invention relates to dispensers for hand soap, and more particularly to dispensers for hand soap that tracks usage for a reward program to positively reinforce clean hygiene.

BACKGROUND

Businesses in the food services industry, as well as businesses within other aspects of the hospitality industry, are becoming keenly aware of the need for their employees to maintain clean hygiene. Having workers frequently clean their hands is critical for providing customers with safe and sanitary food and dishes. Ensuring that a worker cleans their hands is especially important after events such as using the bathroom, taking smoking breaks, and handling cleaning supplies or other chemicals.

Maintaining clean hygiene is important because many contaminates that spread to food can cause illness to the customers who eat it. For example, a worker that does not wash his or her hands after using the rest room may spread fecal bacteria to the food that they handle. This bacteria can result in serious illness, or even death, if ingested. Other forms of bacteria and contaminates can cause a person to become ill as well. Having customers become ill from poor hygiene and contaminated food can result in bad publicity and the loss of business. Causing customers to become ill also can expose a business to law suits and financial liability.

Employers have tried many different devices to encourage workers to clean their hands. Examples of these techniques include electronics that track the number of times that soap is dispensed from a dispenser or mechanisms that sound an alarm if the bathroom door is opened before soap is dispensed from a dispenser. The difficulty with these devices is that they rely on negative reinforcement to maintain compliance with hygiene standards. If not managed properly, such devices can create an environment of mistrust for workers or cause workers to resist compliance with hygiene standards. Another approach to promote good hygiene is to make hand washing easier with dispensers that automatically dispense soap. The difficulty with these devices is that they fail to positively encourage, monitor, or enforce compliance.

Therefore, there is a need for a soap dispenser that positively reinforces compliance with hygiene standards. There is a related need for a soap dispenser that enables a program that rewards workers for good hygiene practices. There is also a related need for a soap dispenser that requires an employer to acknowledge a worker's compliance with hygiene standards.

SUMMARY

One embodiment of the present invention is directed to a system for rewarding and encouraging compliance with a predetermined personal hygiene standard in a hygiene compliance program. The system comprises a fluid dispenser, which includes an actuator. A sensor is connected to the actuator. A processor in electrical communication with the sensor and is configured to increment a count when the sensor is actuated, relate the count to an identification code, and compare the count to a predetermined number.

Another embodiment of the present invention is directed to a method for rewarding and encouraging compliance with a predetermined personal hygiene standard in a hygiene compliance program. The method utilizes an electronic fluid dispenser. The method comprises entering a unique identification code; activating the fluid dispenser; sensing activation of the dispensing mechanism; incrementing a count, the count corresponding to the number of times the fluid dispenser has been activated under the entered unique identification code; displaying a signal when the count equals a predetermined number.

DETAILED DESCRIPTION

Figure 1:
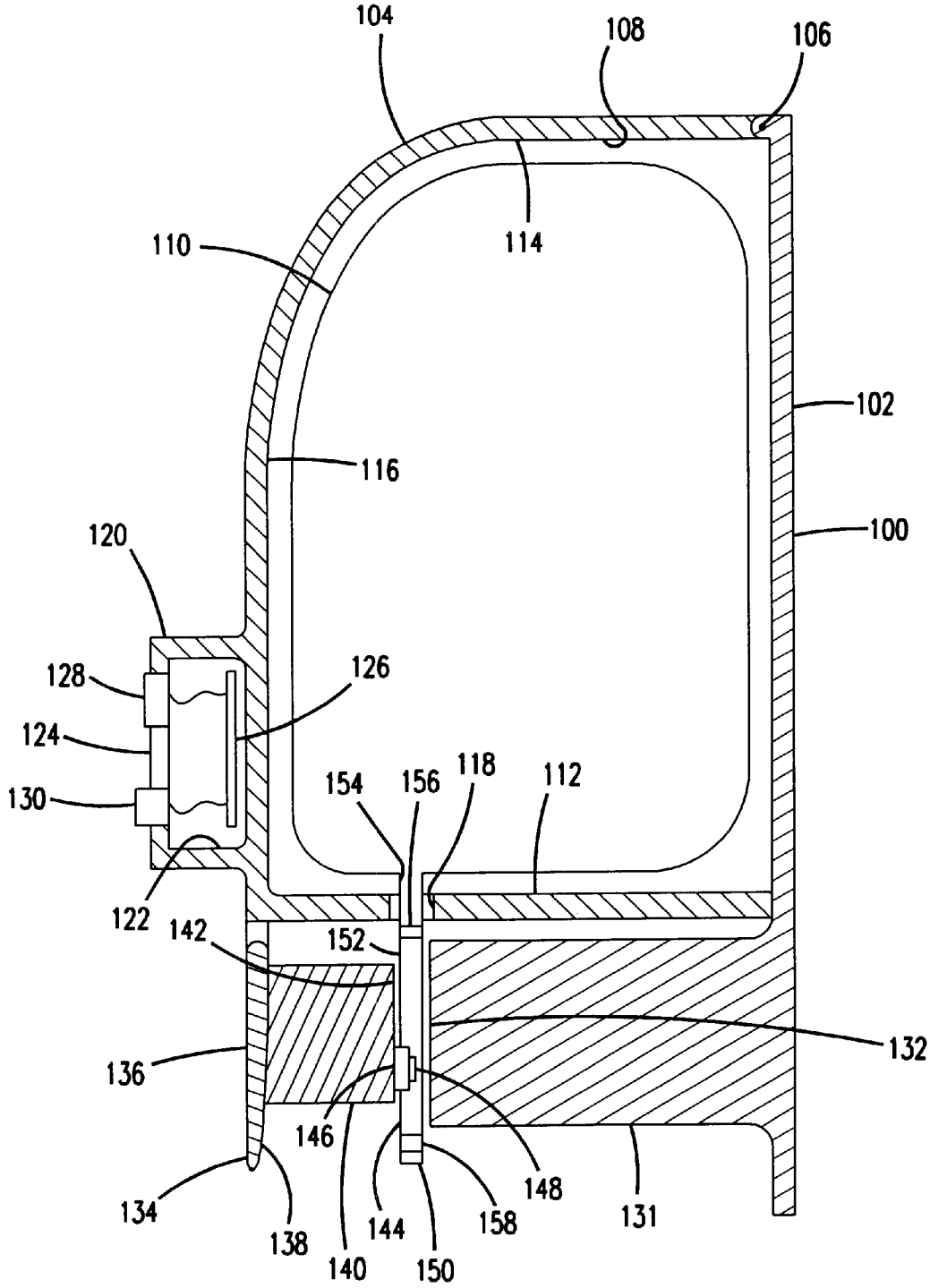
FIG. 1 is a side cross-sectional view of a soap dispenser embodying the present invention.

The present invention will be initially described in general terms. Various embodiments of the present invention, including the preferred embodiment, then will be described in detail with reference to the drawings wherein like reference numerals represent like parts and assemblies throughout the several views. Reference to the described embodiments is not meant to limit the scope of the invention, which is limited only by the scope of the appended claims.

In general terms, the present invention is directed to a dispenser that allows a person to enter an identification code. The dispenser keeps a running total of the number of times the person uses the dispenser and periodically displays a reward that acknowledges a person's use of the dispenser. In one possible embodiment, the dispenser is a soap dispenser that is useful for maintaining clean hygiene in restaurants and other establishments in the hospitality industry.

This invention has several advantages. For example, frequent usage of the dispenser is brought to the attention of employers. The employer can then use the dispenser as part of an employee incentive program to encourage compliance with high standards of hygiene cleanliness. This advantage is especially important given the increasing number of families and people that eat meals at restaurants or rely on prepared foods. These people are increasingly exposed to the risks of food borne contaminates, many of which can be prevented if food handlers simply wash their hands to maintain clean hygiene. The present invention can also be used in conjunction with other methods of control to cast hygiene enforcement into a more positive light. These and other advantages will become apparent from the following description.

Referring now to FIG. 1, one possible embodiment of a soap dispenser 100 is illustrated. An alternative embodiment of a soap dispenser is illustrated in U.S. patent application Ser. No. 09/096,079 which was filed on Jun. 11, 1998 and entitled, USAGE COMPETENT HAND SOAP DISPENSER WITH DATA COLLECTION AND DISPLAY CAPABILITIES, the disclosure of which is hereby incorporated.

The soap dispenser 100 has a rear mounting plate 102 and a cover 104. The mounting plate 102 can be attached to a wall or other suitable surface with fasteners such as screws, clips, hooks, or adhesive tape. The cover 104 is attached to an upper portion of the mounting plate 102 at a pivot point 106 and can pivot open. The cover 104 defines a reservoir cavity 108 in which a plastic reservoir bag 110 of soap is stored. Although a bag 110 is shown in the figure, other embodiments could include other types of reservoirs such as cartridges that are inserted into the reservoir cavity 108. Alternatively, a soap or other fluid could be poured directly into the reservoir cavity 108, which serves as a reservoir itself.

The cover 104 has a lower portion 112, an upper portion 114, and a front portion 116. The lower portion 112 defines a hole 118. A small housing 120 extends from the front portion 116 of the cover 104 and defines an electronics cavity 122. The housing 120 has a front face 124. Electronics 126, which are describe in more detail below, are positioned within the electronic cavity 122 and are electrically connected to a liquid crystal display (LCD) 128 and a push-button interface 130. The LCD 128 and push-button interface 130 are mounted on the front portion 116 of the housing 120 for interaction with a user. If the electronics 126 are battery powered, the housing 120 provides access (not shown) to its electronics cavity 122 for battery changes. The housing 120 is sealed to protect the electronics 126 from water, soap, and other environmental hazards.

A projection 131 is formed in a lower portion of the mounting plate 102 and is positioned below the cover 104. The projection 130 forms a first vertical pressure surface 132. A push plate 134 is pivotally mounted to the lower portion 112 of the cover 104. The push plate 134 has front and back surfaces 136 and 138. A block 140 forming a second vertical pressure surface 142 is mounted to the back surface 138 of the push plate 134. The push plate 134, block 140 and second pressure surface 142 form an actuator for dispensing soap.

The second pressure surface 142 opposes the first pressure surface 132. The first and second pressure surfaces 132 and 142 are spaced to provide passage for a dispensing tube 144, which is described in more detail below. The first and second pressure surfaces 134 and 142 are positioned below and on opposite sides of the hole 118 formed in the lower portion 112 of the cover 104.

A sensor such as a microswitch 146 is mounted to the second pressure surface 142 and has a movable contact or actuator 148 opposing the first pressure surface 132. In this configuration, the movable contact 148 will engage the first pressure surface 132 and actuate the microswitch 146 when a user presses the push plate 134 to dispense soap. The microswitch 146 is in electrical communication with the electronics 126 with leads (not shown).

The replaceable reservoir bag 110, which holds soap, is positioned in the reservoir cavity 108. The dispensing tube 144 has lower and upper ends 150 and 152, a lumen 154, and extends through the hole 118 and between the first and second pressure surfaces 132 and 142. The dispensing tube 144 is in fluid communication with, and extends from the bottom of, the reservoir bag 110. The lower end 150 of the dispensing tube 144 is suspended below the first and second pressure surfaces 132 and 142.

An upper one-way valve 156 is positioned in the lumen 154 and is adjacent the upper end 152 of the dispensing tube 144. The upper one-way valve 156 is positioned above the first and second pressure plates 132 and 142, and is oriented to permit soap flow from the reservoir bag 110 into the lumen 154. A lower one-way valve 158 is positioned in the lumen 154 and is adjacent the lower end 150 of the dispensing tube 144. The lower one-way valve 158 is positioned below the first and second pressure plates 132 and 142, and is oriented to permit soap flow out the lower end 150 of the dispensing tube 144. In use, when a worker presses the push plate, the first and second pressure surfaces cooperate to squeeze the dispensing tube 144 and force soap through the lower one-way valve 158 and out of the distal end.

Figure 2:
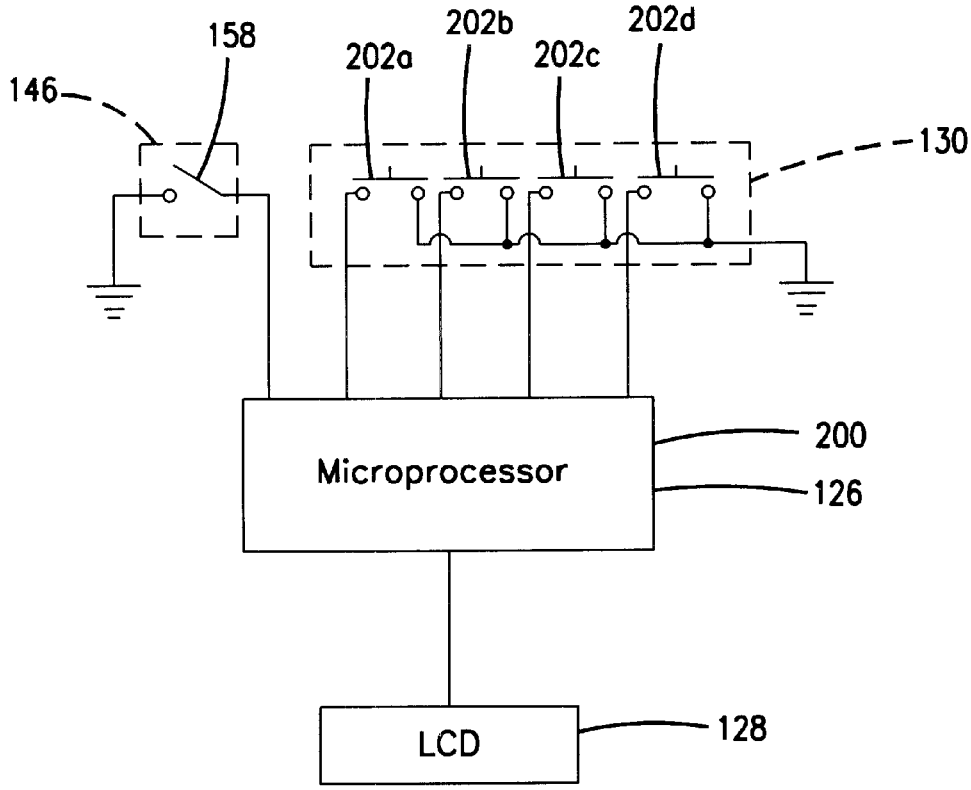
FIG. 2 is a diagram of the electronics included in the soap dispenser shown in FIG. 1.

Referring now to FIG. 2, the electronics 126 include a microcontroller 200. The microswitch 146, LCD 128, and push-button interface 130 are in electrical communication with the microcontroller 200. The push-button interface 130 has four push-button switches 202*a*–202*d*, each of which are labeled with a number 1–4, respectively. Other embodiments could use different types or sizes of keypads.

The electronics 126 are powered by a 9 Volt battery that is electrically connected to a voltage regulator (not shown), a configuration that is well known in the art. The microcontroller 200 is loaded with a program that controls operation of the electronics 126 as described below. In one possible embodiment, the LCD 128 is 1×8 character display module, and the microcontroller 200 is a model 8051, which is manufactured by Intel Corporation. In another possible embodiment, the microcontroller 200, LCD 128, and push button interface 130 are integrated into a low-cost single piece or package that is suitable for battery operation such as the Microchip PIC series, which is manufactured by Microchip Corporation. In other possible embodiments, the microcontroller 200 can be replaced with a microcontroller configured with suitable memory, a microprocessor and suitable memory, or any other suitable processor. In all such embodiments, the code is programmed using any suitable computer language.

As will become apparent during the following description of the flowcharts, memory within the microcontroller 200 stores an ID code for each worker that corresponds to a unique sequence of the push-button switches 202*a*–202*d*. The program executed by the microcontroller 200 utilizes a set of variables named Dispense Count, Reward Count, Random Number, Mean Value, and Mean. Dispense Count is the number of times that a particular worker has used the soap dispenser. There are a plurality of values for Dispense Count, each value being associated with a particular ID code. Reward Count is the number of times that a worker must dispense soap to receive a reward. Random Number is a randomly generated number within a predetermined range such as 1 to 31. Mean Value is assigned one of several predetermined values. In one possible embodiment, Mean Value is assigned either 34, 84, or 184. Mean is used to determine Mean Value.

Reward Count is determined according to the equation:

$$\text{Reward Count} = \text{Mean Value} + \text{Random Number}$$

In an embodiment that uses the values set forth above, this calculation provides that the Reward Count is within one of three predetermined ranges: 35–65, 85–115, or 185–215. For each worker, the value for the Reward Count will fall within one of these ranges. An advantage of this configuration is that the Reward Count becomes more difficult to predict, which reduces the motivation for a worker to repeatedly dispense soap in an effort to reach the Reward Count.

Furthermore, these calculations are only one possible embodiment of the present invention. For example, other embodiments will use different ranges for the possible reward count, increase randomness by providing more values for the variable Mean Value, or increase randomness by providing a greater range for the possible values of the variable Random Num. Yet other possible embodiments might use a straight random number generator to determine the Reward Count.

Figure 3A:
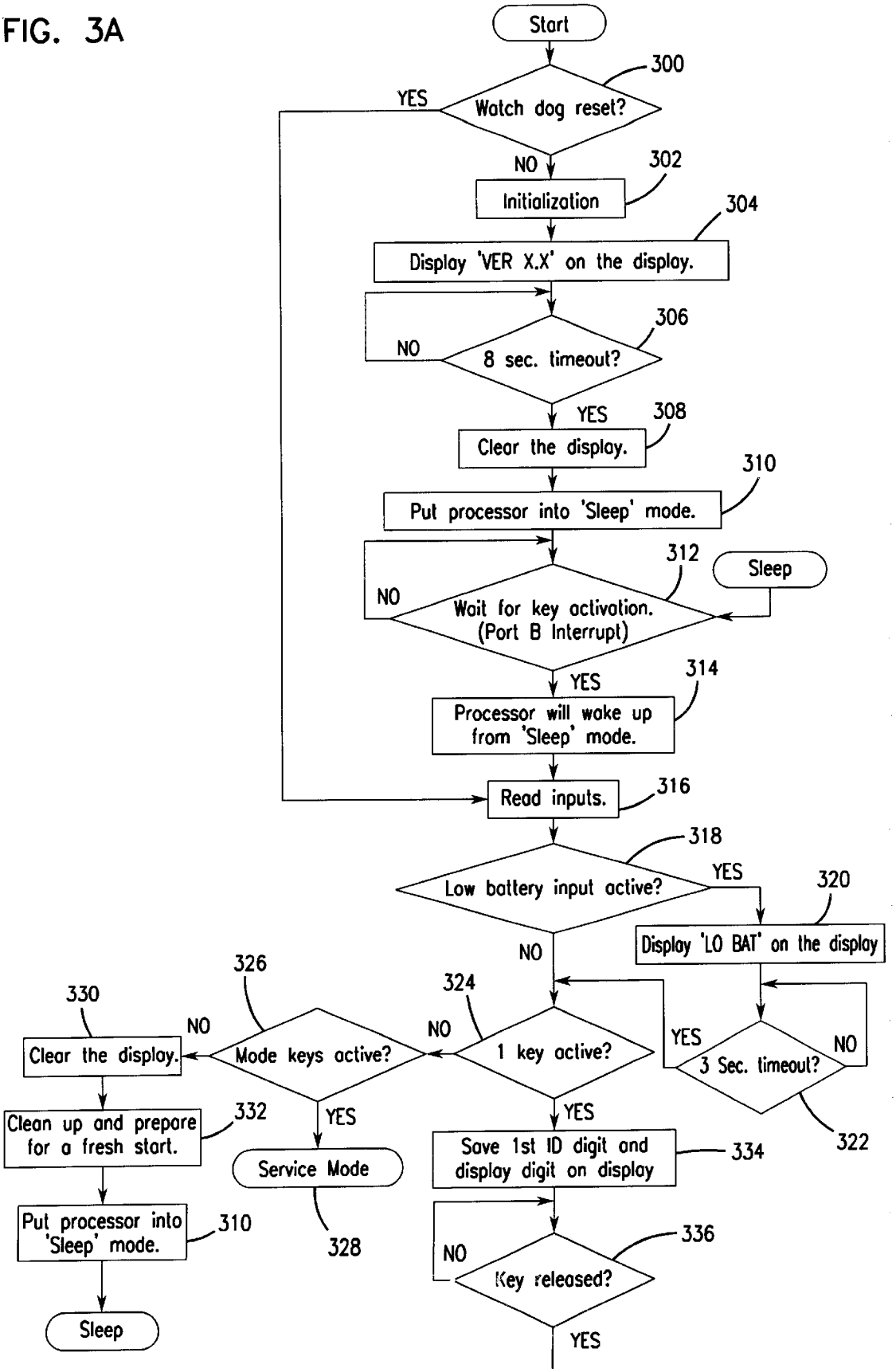
FIGS. 3–6 are flowcharts illustrating the functionality of one possible program that controls the electronics shown in FIG. 2.
Figure 3B:
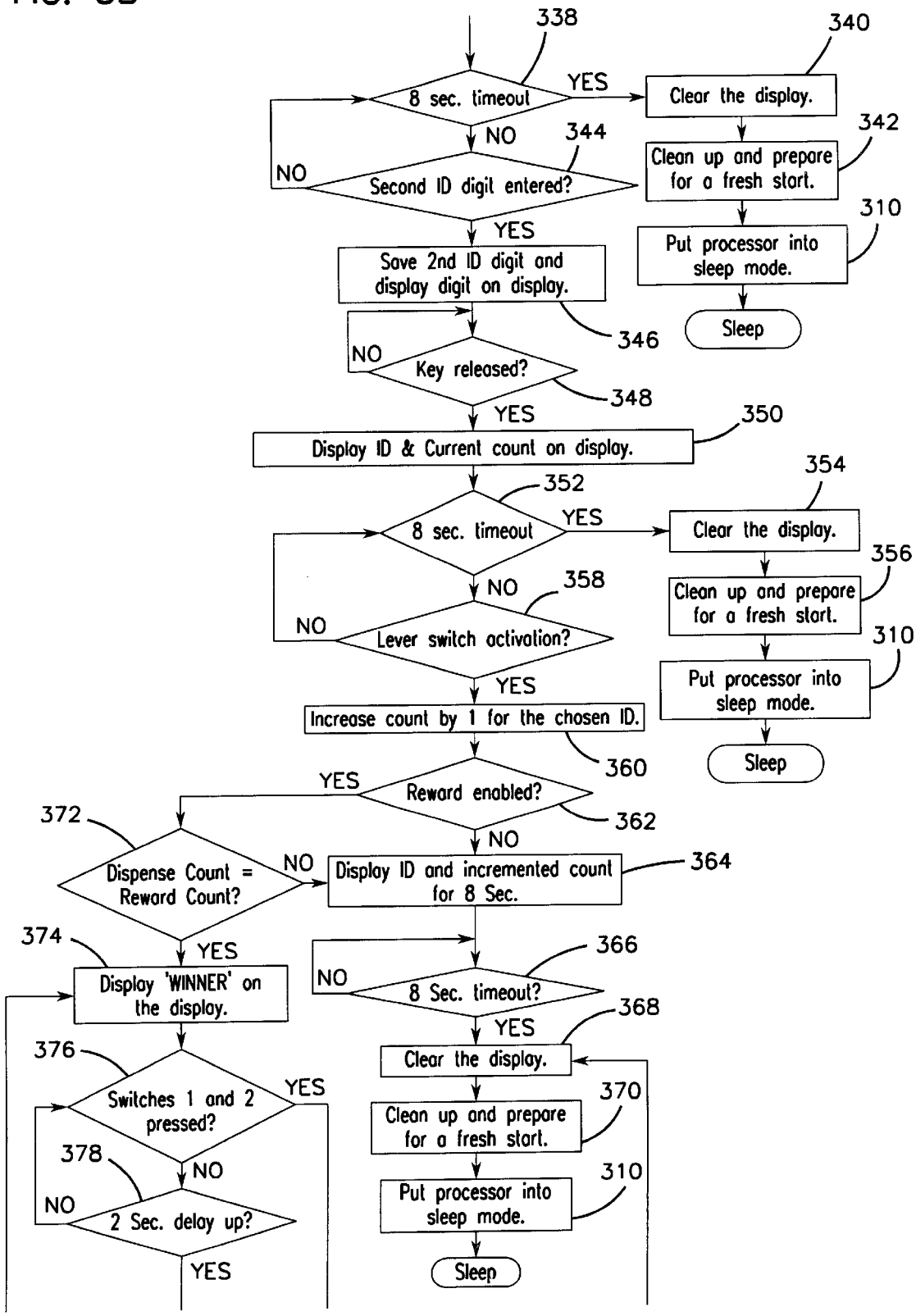
Figure 3C:
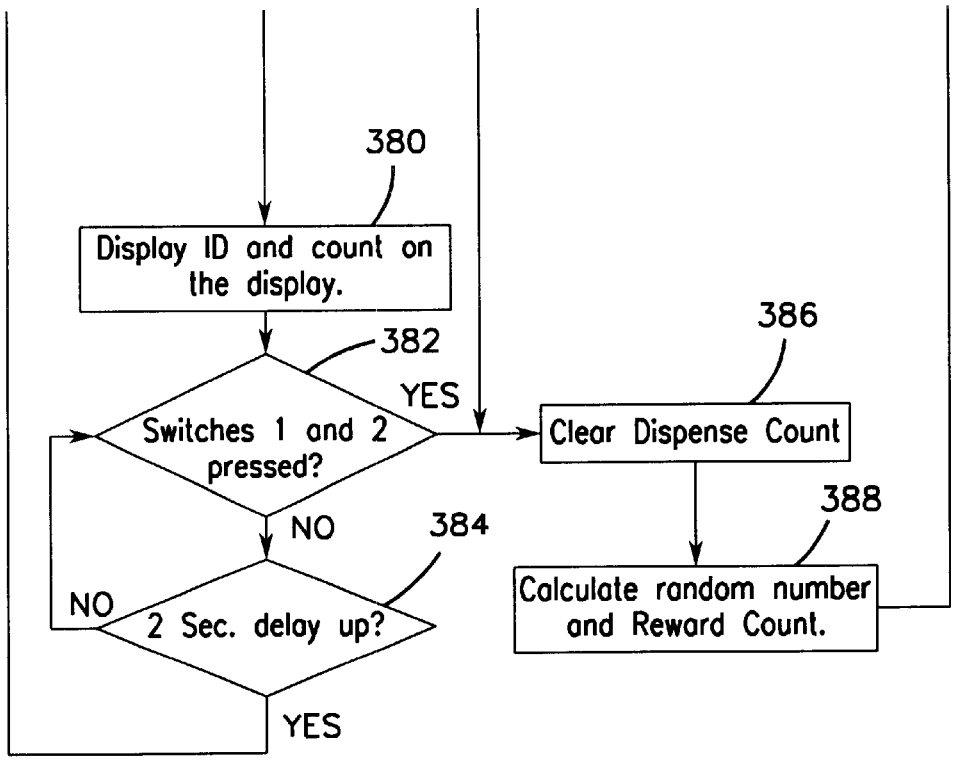

Referring now to FIGS. 3A–3C, upon being booted, the program initially determines whether the watch dog timer within the microcontroller 200 was reset (Block 300). If the watch dog timer was reset, execution of the program automatically jumps to the code for reading inputs (Block 316). Otherwise, the program goes through its initialization (Block 302) at which time it initializes variables and executes appropriate diagnostics. The program then displays the current version of the software for a period of eight seconds (Blocks 304 and 306). The program clears the display (Block 308) and enters a sleep mode (Block 310). While in the sleep mode, the microcontroller 200 enters a state in which it conserves energy and waits for detection of an interrupt that is initiated by pressing one of the push-button switches 202*a*–202*d* (Block 312).

The microcontroller 200 wakes from the sleep mode upon receiving an interrupt (Block 314) and then reads the inputs (Block 316) to determine which push-button switches 202*a*–202*d* were activated. Upon reading the inputs, the program determines whether the low battery input is active (Block 318). If so, the program displays "LOW BAT" on the LCD 128 for approximately three seconds (Blocks 320 and 322).

The program then determines whether only one or more of the push-button switches 202*a*–202*d* were pressed (Block 324). If two or more push-button switches 202*a*–202*d* are simultaneously pressed, the program determines whether these switches 202*a*–202*d* match a predetermined code that is required to enter into a service mode (Block 326). If the predetermined combination of switches 202*a*–202*d* were pressed, the program enters into the service mode (Block 328), which is described in more detail below. For example, the code to enter the service mode might be set at one and four. If the user simultaneously presses the first and the fourth push-button switches 202*a* and 202*d,* the program will enter into the service mode. If two switches 202*a*–202*d* that do not match the code are simultaneously pressed, the LCD 146 is cleared (Block 330), the registers and transient variables are cleared (Block 332), and the microcontroller 200 enters into the sleep mode (Block 310).

When in the service mode, the employer can perform functions such as enabling or disabling the reward program, changing the value of Mean Value, viewing the values for Dispensed Count that are associated with each worker, and clearing the values for Dispensed Count. The service mode is described in more detail below.

If only one push-button switch 202*a*–202*d* is pressed (Block 324), the microcontroller saves the first ID digit that corresponds to that push-button switch 202*a*–202*d* and displays the ID digit on the LCD 146 (Block 334). For example, if the second push-button switch 202*b* is pressed, the program will save the number two and display that number two on the LCD 146. When that push-button switch 202*b* is released (Block 336), the program enters into an eight-second time-out period (Block 338). If eight seconds elapses before a second push-button switch 202*a*–202*d* is pressed, the LCD 146 is cleared (Block 340), the registers and transient variables are cleared (Block 342), and the microcontroller 200 enters into the sleep mode (Block 310).

If a second push button switch 202*b* is subsequently entered within the eight-second time-out period (Block 344), the program saves the ID digit corresponding to the second push-button switch 202*b* (Block 346) in a register. The second ID digit can be the same as the first ID digit. When the second push-button switch 202*b* is released (Block 348), the first and second ID digits corresponding to the two push-button switches that were pressed is displayed on the LCD 146 (Block 350). The program also displays on the LCD 146 the value for Dispense Count that corresponds to that ID (Block 350). The current value of the Dispense Count is the number of times that the displayed ID was entered and soap was dispensed from the soap dispenser 100.

After the two digit ID code is entered, the program enters into a second eight-second time-out period (Block 352) to determine whether the microswitch 146 was closed, which indicates that soap was dispensed. If the eight-second time-out period lapses without the microswitch 146 being closed, the LCD 146 is cleared (Block 354), the registers and transient variables are cleared (Block 356), and the microcontroller 200 enters the sleep mode (Block 310). If the microswitch 146 is closed (Block 358) before the eight-second time-out period lapses, the current value for the Dispense Count is increased by one for the current ID code (Block 360). If the reward is not enabled (Block 362), the current ID code is displayed and its incremented value for the Dispense Count is displayed on the LCD 146 for eight seconds (Blocks 364 and 366). After the eight-second time-out period lapses, the LCD 146 is cleared (Block 368), the registers and transient variables are cleared (Block 370), and the microcontroller 200 enters the sleep mode (Block 310).

If the reward program is enabled (Block 362), the program determines whether Dispense Count=Reward Count (Block 372). If the two values are not equal, the program displays the current ID CODE and the associated incremented Display Count for eight seconds (Blocks 364 and 366). The LCD 146 is then cleared (Block 368), the registers and transient variables are cleared (Block 370), and the microcontroller enters into the sleep mode (Block 310). If Dispense Count=Reward Count (Block 372), the program displays "WINNER" on the LCD 146 (Block 374).

The program then waits for the employer to press the first and second push-button switches 202*a* and 202*b,* or some other predetermined combination of switches 202*a*–202*d,* within two seconds of each other (Blocks 376 and 378). If these switches 202*a* and 202*b* are not pressed within two seconds of each other, the current ID CODE and associated value for Dispense Count are displayed on the LCD 146 (Block 380). If these switches 202*a* and 202*b* are not pressed within an additional two second delay (Blocks 382 and 384), the program redisplays "WINNER" on the LCD 146 (Block 374). The program then enters a loop in which the display of the current ID CODE and Dispense Count are alternated with display of the term "WINNER" (Blocks 374–384). When the first and second push-button switches 202*a* and 202*b* are finally pressed, the program clears the value for Dispense Count (Block 386) and recalculates Random Number and Reward Count (Block 388). The LCD 146 is then cleared (Block 368), the registers and transient variables are cleared (Block 370), and the microcontroller 200 enters the sleep mode (Block 310).

The goal reflected in Reward Count is thus reset for all workers, who must start over in their request to be a "WINNER". In this embodiment, the workers compete against one another in an effort to reach the reward count. In an alternative embodiment, each individual worker has his/her own reward count and thus competes against themselves rather than each other.

Figure 4:
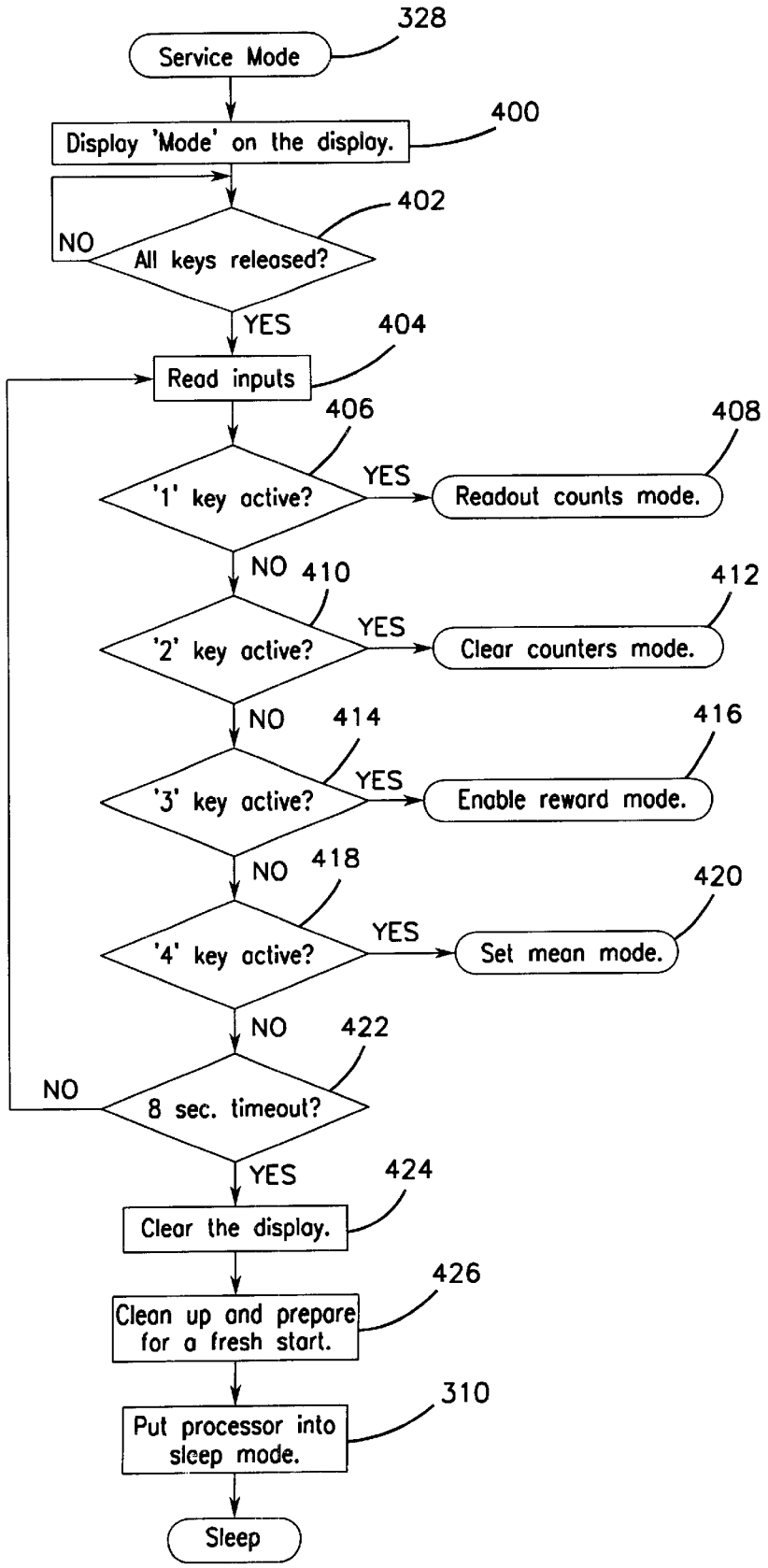

Referring now to FIG. 4, when the program enters the service mode (Block 328), it displays the term "Mode" on the LCD 146 (Block 400). The program enters a wait state until all of the push-button switches 202*a*–202*d* are released (Block 402). After all of the push-button switches 202*a*–202*d* are released, the program reads inputs to determine whether any push-button switches 202*a*–202*d* are subsequently pressed (Block 404). The program will read inputs for a period of eight seconds (Block 422). If no push-button switch 202*a*–202*d* is pressed, the LCD 146 is cleared (Block 424), the registers and transient variables are cleared (Block 426), and the microcontroller 200 enters the sleep mode (Block 310).

If the first push-button switch 202*a* was pressed within the eight-second time-out period (Block 406), the program enters a Readout Counts Mode (Block 408). In this mode, the program displays each ID CODE and its associated value for the Dispense Count on the LCD 146. The program indexes through displaying each ID CODE and its a associated Dispense Count. If the second push-button switch 202*b* is pressed (Block 410), the program enters a Clear Counters Mode (Block 412). In this mode, the program automatically clears all of the values for the variable Dispense Count that are assigned to an ID CODE. If the third push-button switch 202*c* is pressed (Block 414), the program enters an Enable Reward Mode (Block 416). The Enable Reward Mode is described in more detail below. If the fourth push-button switch 202*d* is pressed (Block 418), the program enters a Set Mean Mode (Block 420), which is also explained below in more detail. After each of the program modes are complete (Blocks 408, 412, 416, and 420), the LCD 146 is cleared, the registers and transient variables are cleared, and the microcontroller 200 enters the sleep mode.

Figure 5:
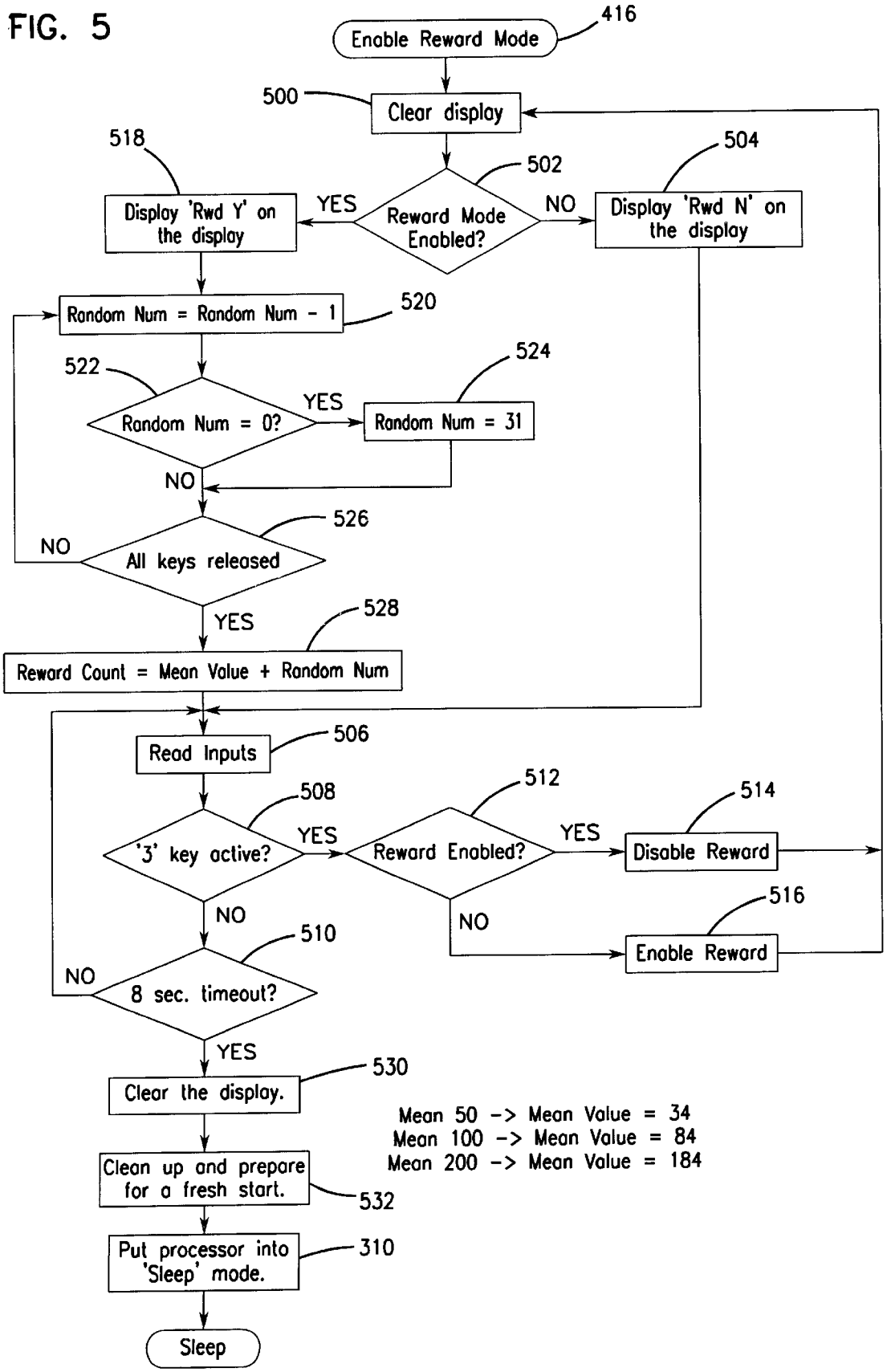

Referring now to FIG. 5, when the program enters the Enable Reward Mode (Block 416), it initially clears the display (Block 500) and immediately determines whether the Reward Mode is currently enabled (Block 502). If the program determines that the reward mode is enabled (Block 502), it initially displays the message "Rwd Y" on the LCD 146 (Block 518) and executes a random number algorithm that generates a value for Random Num. The random number algorithm (Blocks 520–526) is executed while the employer is pressing the third push-button switch (Block 414) to enter the Enable Reward Mode. The random number algorithm (Blocks 520–526) calculates Random Num according to the equation: Random Num=Random Num−1, which decrements the current value for Random Num (Block 520). If Random Num=0 (Block 522), the processor automatically resets Random Num=31 (Block 524). The random number algorithm then loops around and decrements Random Num again (Blocks 520–524) until the all of the bush-button switches are release (Block 526). This random number algorithm (Blocks 520–526) automatically generates the random number between a value of 1 and 31 whenever the third push-button switch is pressed to enter the Enabled Reward Mode (Block 416).

If the program determines that the reward mode is not enabled (Block 502), it initially displays the message "Rwd N" on the LCD 146 (Block 504). The program then reads the inputs (Block 506) to determine whether any push-button switches 202*a*–202*d* have been pressed. If the third push-button switch 202*c* is pressed within an eight second period (Blocks 508 and 510), the program again determines whether the reward mode is enabled (Block 512). If the reward program is enabled, the program disables the reward program (Block 514). If the reward program is not enabled, the program enables the reward program (Block 516), executes the random number algorithm (Blocks 520–526), and calculates Reward Count (Block 528) as described above. In this configuration, the push-button switch that is pressed to toggle the reward mode on and off (Block 508) is the same as the push-button switch used to enter the Enable Reward Mode (Block 414).

Basing the value of Reward Count on the automatic generation of Reward Count helps to maintain a level of randomness so that workers (and Employers) cannot predict when an employee will become entitled to a reward. This randomness discourages employees from trying to circumvent the reward program by repeatedly activating the soap dispenser.

In other embodiments, an employer enters the Enable Reward Mode and toggles between enabled and disabled states using a push-button switch, or switches, other than the third one. In yet other possible embodiments, the program is coded so that an employer enters the Enable Reward Mode and toggles the Reward Mode between enabled and disabled states using different push-button switches. In still other possible embodiments, the employer can manually enter a value for Reward Count.

After the eight-second period lapses without the third push-button switch 202*c* being activated (Block 510), the LCD 146 is cleared (Block 530), the registers and transient variables are cleared (Block 532), and the microcontroller 200 enters the sleep mode (Block 310), thereby exiting the Enable Reward Mode.

Figure 6:
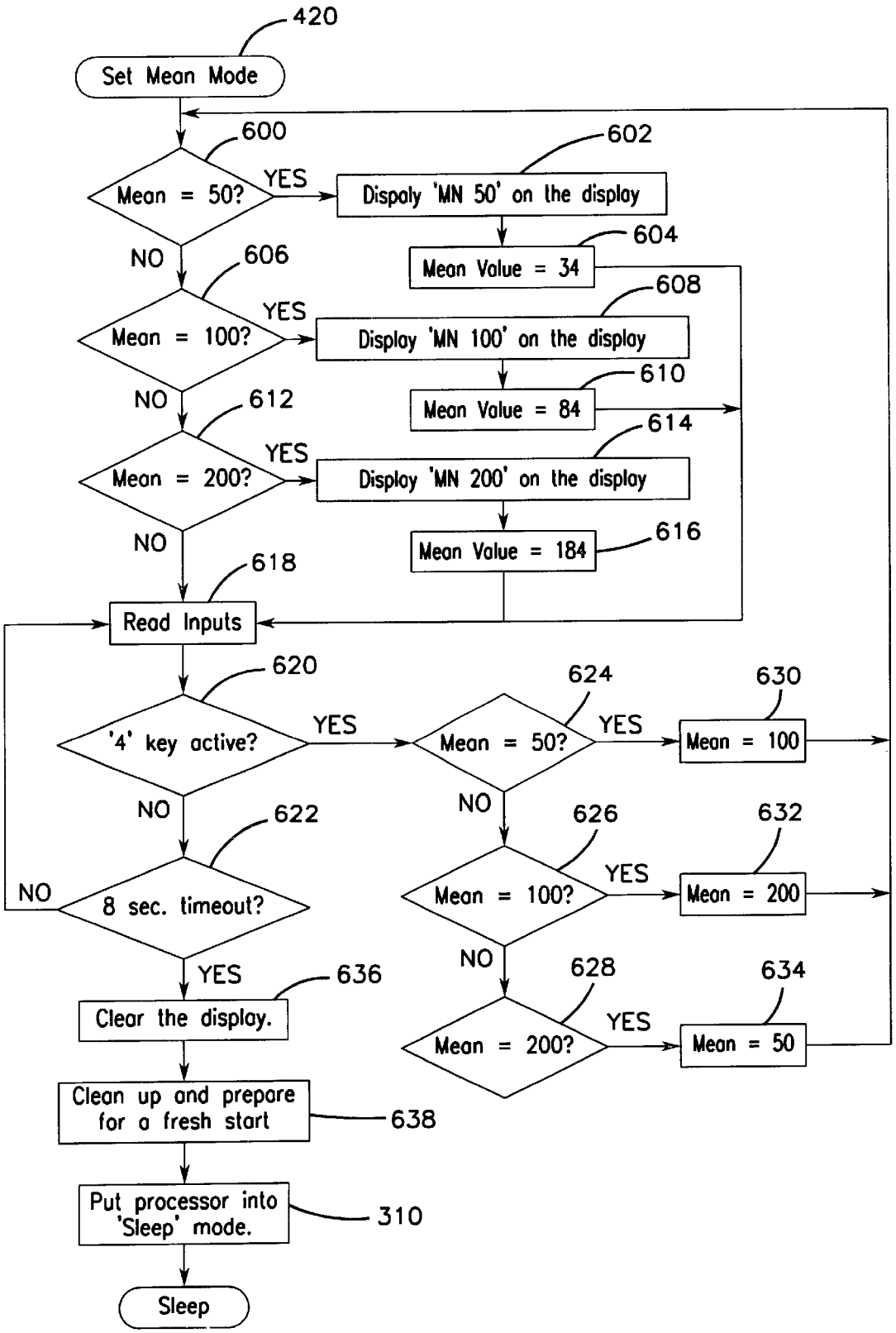

Referring now to FIG. 6, when the employer presses the fourth push-button switch 202*d* to enter the Set Mean Mode (Block 420) as described above, the program immediately determines the current value for the variable Mean (Blocks 600, 606, 612). If Mean=50 (Block 600), the program displays the message "MN 50" on the LCD 146 (Block 602) and sets Mean Value=34 (Block 604). If Mean=100 (Block 606), the program displays the message "MN 100" on the LCD 146 (Block 608) and sets Mean Value=84 (Block 610). If Mean=200 (Block 612), the program displays the message "MN 200" on the LCD 146 (Block 614) and sets Mean Value=184 (Block 616).

After the value for Mean Value is set (Blocks 604, 610, 616), the program reads inputs (Block 618) for a period of eight seconds (Block 622) to determine whether the fourth push-button switch 202*d* is still being pressed or if it is being pressed again (Block 618). If the fourth push-button switch 202*d* is being pressed (Block 620), the program again determines the current value for the variable Mean (Blocks 624, 626, and 628). If Mean=50 (Block 624), the program resets Mean=100 (Block 630). If Mean=100 (Block 626), the program resets Mean=200 (Block 632). If Mean=200 (Block 628), the program resets Mean=50 (Block 634). The program then loops and reassigns values for Mean Value (Blocks 604, 610, and 616) depending on the newly assigned value for Mean (Blocks 600, 606, and 612).

This loop within the Set Mean Mode (Block 420) automatically reassigns values for Mean Value, which is used in calculating the Reward Count as described above. Accordingly, another element of randomness is added to Reward Count. If Mean Value=34, then the value of Reward Count is between 35 and 65. If Mean Value=84, then the value of Reward Count is between 85 and 115. If Mean Value=184, then the value of Reward Count is between 185 and 215. Although examples of certain ranges are given, other embodiments include other ranges. In yet another possible embodiment, the employer can manually set a range of possible values for Reward Count.

After eight seconds lapses (Block 622), the LCD 146 is cleared (Block 636), the registers and transient variables are cleared (Block 638), and the microcontroller 200 enters the sleep mode (Block 310).

Although the description of the various embodiments and methods have been quite specific, it is contemplated that modifications could be made without deviating from the spirit of the present invention. Accordingly, it is intended that the scope of the present invention be dictated by the appended claims, rather than by the description of the various embodiments and methods.

The claimed invention is:

1. A method for rewarding and encouraging compliance with a predetermined personal hygiene standard in a hygiene compliance program, the method utilizing an electronic fluid dispenser, the method comprising:

entering a user's unique identification code;

activating the fluid dispenser;

sensing activation of the dispensing mechanism;

incrementing a count, the count corresponding to the number of times the fluid dispenser has been activated under the entered unique identification code; displaying a message when the count equals a predetermined number; and associating an incentive reward to the corresponding predetermined number.

2. The method according to claim 1 further comprising displaying the incremented count.

3. The method according to claim 1 wherein the predetermined number is programmable.

4. The method according to claim 1, further comprising entering an acknowledgment when the incremented count equals the predetermined number.

5. The method according to claim 1 wherein the activation step occurs within a predetermined period of entering the user's unique identification code.

6. The method according to claim 5 wherein the predetermined period is 8 seconds.

7. The method according to claim 1 wherein incrementing a count is performed by a microcontroller.

8. The method according to claim 7 wherein the microcontroller is battery powered.

9. The method according to claim 1 wherein the dispensing apparatus is a hand soap dispenser.

10. The method according to claim 1 wherein sensing activation of the dispensing mechanism is performed by closing a switch.

11. The method according to claim 1 wherein entering a user's unique identification code is performed by pressing keys on a keypad.

12. The method according to claim 11 wherein the keypad is formed from four push-button switches.

13. The method according to claim 1 further comprising dispensing a fluid.

14. The method of claim 13 wherein the act of dispensing a fluid includes dispensing a soap.

15. A system for rewarding and encouraging compliance with a predetermined personal hygiene standard in a hygiene compliance program, the system comprising:

a fluid dispenser, the fluid dispenser including an actuator;

a sensor connected to the actuator;

a processor in electrical communication with the sensor, the processor configured to increment a count when the actuator is actuated, relate the count to an identification code, compare the count to a predetermined number, and generate a message when the count equals the predetermined number; and a display arranged to display the message.

16. The system of claim 15 wherein the predetermined number is randomly generated.

17. The system of claim 15 wherein the processor is further configured to display the message when the count is greater than the predetermined number.

18. The system of claim 15 further comprising a keypad in electrical communication with the processor.

19. The system of claim 15 wherein the processor is selected from the group consisting essentially of: a microprocessor and a microcontroller.

20. The system of claim 19 wherein the processor is in electrical communication with firmware, the firmware embodying computer code.

21. The system of claim 20 further comprising memory in communication with the processor, the memory configured to store a plurality of identification codes and a plurality of counts, each count being related to different identification code.

22. The system of claim 21 wherein the processor is further configured to retrieve from memory at least one of the identification codes and related count from memory and display the retrieved identification code and related count on the display.

23. The system of claim 15, wherein the sensor is a switch.

24. The system of claim 15 wherein the fluid dispenser defines a reservoir, the system further comprising:

fluid within the reservoir.

25. The system of claim 24 wherein the fluid is a soap.

* * * * *